United States Patent [19]

Whiteford

[11] Patent Number: 4,688,851

[45] Date of Patent: Aug. 25, 1987

[54] SEATING ASSIST DEVICE WITH ADJUSTABLE SPRING ASSEMBLY

[75] Inventor: Carlton Whiteford, Westport, Conn.

[73] Assignees: Henry E. Allen, Greenwich, Conn.; Carl White, Jr., Arlington, Vt.; Mortimer Schwartz, Ridgefield; Andrew Ziolkowski, Norwalk, both of Conn.

[21] Appl. No.: 826,963

[22] Filed: Feb. 7, 1986

[51] Int. Cl.[4] ..... A47C 1/02

[52] U.S. Cl. ..... 297/313; 297/337; 297/DIG. 10

[58] Field of Search ..... 267/131, 151, 164, 158; 297/DIG. 10, 313, 304, 337; 16/332, 225, 226, DIG. 13, 298, 277

[56] References Cited

U.S. PATENT DOCUMENTS

| | | | |
|---|---|---|---|
| 1,025,915 | 5/1912 | Hoff | 297/332 |
| 1,288,216 | 12/1918 | Sayles | 297/332 X |
| 1,566,173 | 12/1925 | Storck | 267/131 |
| 1,698,344 | 1/1929 | Mott | 297/332 X |
| 1,986,259 | 1/1935 | Fischer | 206/41 |
| 2,039,342 | 8/1937 | Pielstick | 267/1 |
| 2,089,761 | 11/1944 | Pielstick | 267/165 |
| 2,362,746 | 8/1949 | De Vries | 297/326 X |
| 2,478,112 | 1/1951 | Larsen | 297/258 |
| 2,539,034 | 6/1962 | Ruby | 297/332 |
| 3,039,221 | 11/1964 | Musgrave | 267/165 |
| 3,092,870 | 6/1963 | Baer | 16/277 |
| 3,158,398 | 10/1970 | Stryker | 4/237 |
| 3,536,313 | 10/1970 | Rice | 267/165 |
| 3,616,487 | 11/1971 | Dearth | 16/225 |
| 3,640,566 | 2/1972 | Hodge | 5/68 X |
| 3,679,260 | 7/1972 | Morse-Brown | 297/338 |
| 3,737,155 | 6/1973 | Karlan | 267/165 |
| 3,851,917 | 12/1974 | Horstman et al. | 297/345 |
| 4,031,576 | 6/1977 | Epstein | 4/251 |
| 4,127,214 | 11/1978 | Pedraid | 16/255 |
| 4,139,214 | 2/1979 | Meyer | 280/607 |

FOREIGN PATENT DOCUMENTS

| | | |
|---|---|---|
| 494034 | 7/1975 | Australia . |
| 949995 | 2/1964 | United Kingdom . |
| 1500361 | 2/1978 | United Kingdom . |
| 1578395 | 11/1980 | United Kingdom . |

*Primary Examiner*—James T. McCall

*Attorney, Agent, or Firm*—Finnegan, Henderson, Farabow, Garrett and Dunner

[57] ABSTRACT

A seating assist device including a base member, a seat member for receiving a person to a seated position, a main spring for simultaneously acting as a hinge between the base member and the seat means, and exerting a resilient force biasing the seat member away from the base member, and an arrangement for adjusting the resilient force of the main spring including at least one helper spring sized for close fitting relation with the main spring. An adjustable spring assembly having a main spring with a generally C-shaped portion, at least one helper spring sized for close fitting relation with the main spring for varying the resilient force of the assembly, and means for securing the helper spring to the main spring including a pair of guides on opposite ends of the C-shaped portion and a pair of corresponding grooves on the helper spring for frictionally contacting the guides when the helper spring is manually inserted within the C-shaped portion, is also disclosed.

26 Claims, 7 Drawing Figures

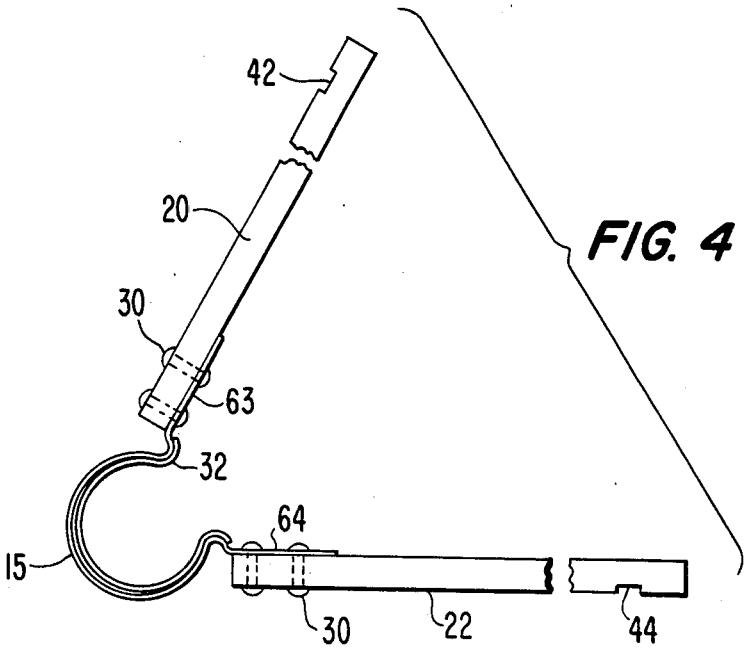
FIG. 4
FIG. 5
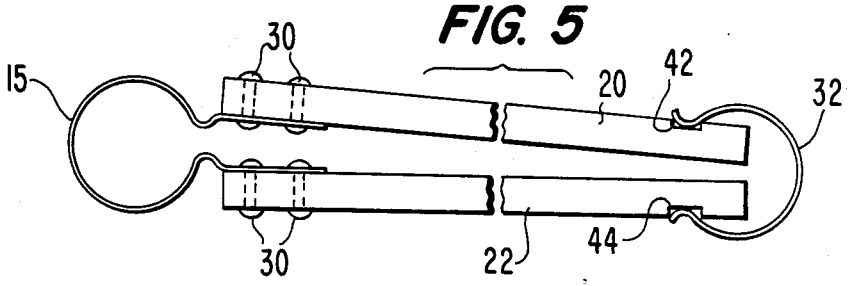
FIG. 6
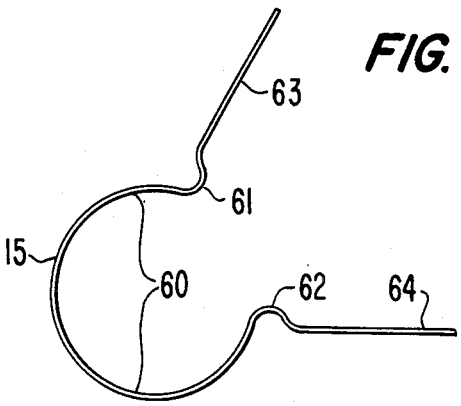
FIG. 7
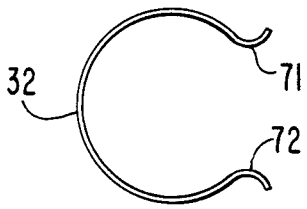

SEATING ASSIST DEVICE WITH ADJUSTABLE SPRING ASSEMBLY

BACKGROUND OF THE INVENTION

This invention relates generally to devices which assist an individual in rising from a seated position, and also to spring assemblies in which the force of the spring is adjustable.

Many elderly people, as well as overweight and infirm people experience considerable difficulty in rising from a seated position in a chair or other furniture piece. This has become a particular problem with the increasing use of modern designs for such furniture, which are often closer to the floor, or support an individual in a slightly reclining position. Those with weak or inferior joints and muscles, arthritis or other types of muscular or joint crippling diseases and other such infirmities experience particular difficulty in these situations. In addition, individuals of all ages who experience back ailments often have great difficulty and discomfort in rising from many types of furniture.

Such problems are also encountered by people who are required by their occupation to sit and rise with great frequency, such as office secretaries. This type of repeated sitting and rising can cause excessive wear and strain on the lower back muscles and an attendant degree of discomfort and fatigue.

A number of attempts have been made in the prior art to solve this problem. For example, Sayles U.S. Pat. No. 1,288,216, Watt U.S. Pat. No. 1,698,344, Ruby U.S. Pat. No. 2,529,034 and Stryker U.S. Pat. No. 3,158,398 all describe seats of various types which pivot in the vicinity of their front edges to assist an occupant in rising from a seated position to a standing position. In Stryker, the seat tilts forward about a horizontal axis near its front edge under the action of torsion springs which encircle hinge pins as shown in FIG. 9 of that patent. Other prior art structures are shown in Gaffney U.S. Pat. No. 3,250,569, Condon U.S. Pat. No. 3,623,767 and Andreasson U.S. Pat. No. 4,249,774, all of which include power of motor driven seats to assist an individual in rising from a seated position.

Applicant is also aware of a commercially available device called a "lifting seat" which is portable and may be placed on a chair or other furniture piece. Although the device uses a spring for providing a resilient force to assist in rising, the spring is not adjustable, and the device is only available for specific weight ranges.

In general, previous approaches to solving this problem have been somewhat complex and expensive to produce. Moreoever, previous seating assist devices have not been easily adjustable for use by individuals of different weights and have not been easily adjustable in small increments to be precisely adjustable for the weight of the person using the chair.

Accordingly, it is an object of this invention to simply and inexpensively assist an individual in rising from a seated position.

It is also an object of the invention to provide a device which is easy to manufacture and operate, and which can be used to assist individuals of greatly varying weights to rise from a seated position.

It is another object of the invention to provide a device which may be made portable and which is lightweight and comfortable to sit on.

It is a further object of the invention to provide an adjustable spring assembly wherein the resilient force of the assembly may be quickly and easily changed.

It is also an object of the invention to provide an adjustable spring assembly for a chair in which the resilient force may be changed in small increments so as to be precisely adjustable for the weight of the individual using the chair.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the purposes of this invention, as embodied and broadly described herein, the seating assist device of the invention comprises a base member; seat means for receiving a person to a seated position; main spring means for simultaneously acting as a hinge between the base means and the seat means, and exerting a resilient force biasing the seat means away from the base member; and means for adjusting the resilient force of the main spring means. Preferably the adjusting means includes at least one helper spring sized for close fitting relation with the spring means.

The base member may include a portion or a framework of a chair, or alternatively, the base member and seat means may be formed of lightweight materials so that the device is portable. Preferably, the main spring means includes a plurality of springs each having a generally C-shaped portion. It is also preferred that the means for adjusting include a plurality of helper springs for varying the resilient force of the main spring means.

The base member and seat means may be substantially planar, and in this configuration the main spring means maintains the seat means and the base member at an acute angle with respect to each other when the main spring means is in its unstressed condition. Preferably, the base member is dimensioned for approximating the longitudinal and lateral dimensions of the seat portion of a normal chair.

In a preferred embodiment, the main spring means includes means for securing the helper spring to the main spring means, which may include a pair of guides on opposite ends of the C-shaped portion. In this embodiment, the helper spring also includes a pair of corresponding grooves for frictionally contacting the guides when the helper spring is manually inserted within the C-shaped portion.

Preferably, the helper spring is spaced from the C-shaped portion of the main spring means except at the grooves for reducing noise when the main spring means is stressed.

The invention also includes an adjustable spring assembly comprising a main spring having a generally C-shaped portion; at leat ne helper spring sized for close fitting relation against the main spring for varying the resilient force of the assembly; and means for securing the helper spring to the main spring, incuding a pair of guides on opposite sides of the C-shaped portion, and a pair of corresponding grooves on the helper spring for frictionally contacting the guides when the helper spring is manually inserted within the C-shaped portion.

BRIEF DESCRIPTION OF THE DRAWINGS

The accompanying drawings which are incorporated in and constitute a part of this specification, illustrate at least one embodiment of the invention and, together with the description, serve to explain the principles of the invention.

FIG. 4 is a side view of the embodiment shown in FIG. 2 with both of the spring means in unstressed condition;

FIG. 5 is a side view of the device of FIG. 4 with the main spring means in a fully stressed condition, and a helper spring being used for holding the device in that position for shipping or travel;

FIG. 6 is a side view of the preferred embodiment of the main spring showing the guides; and FIG. 7 is a side view of the preferred configuration of a helper spring showing the grooves thereon.

DESCRIPTION OF THE PREFERRED EMBODIMENTS

Figure 1:
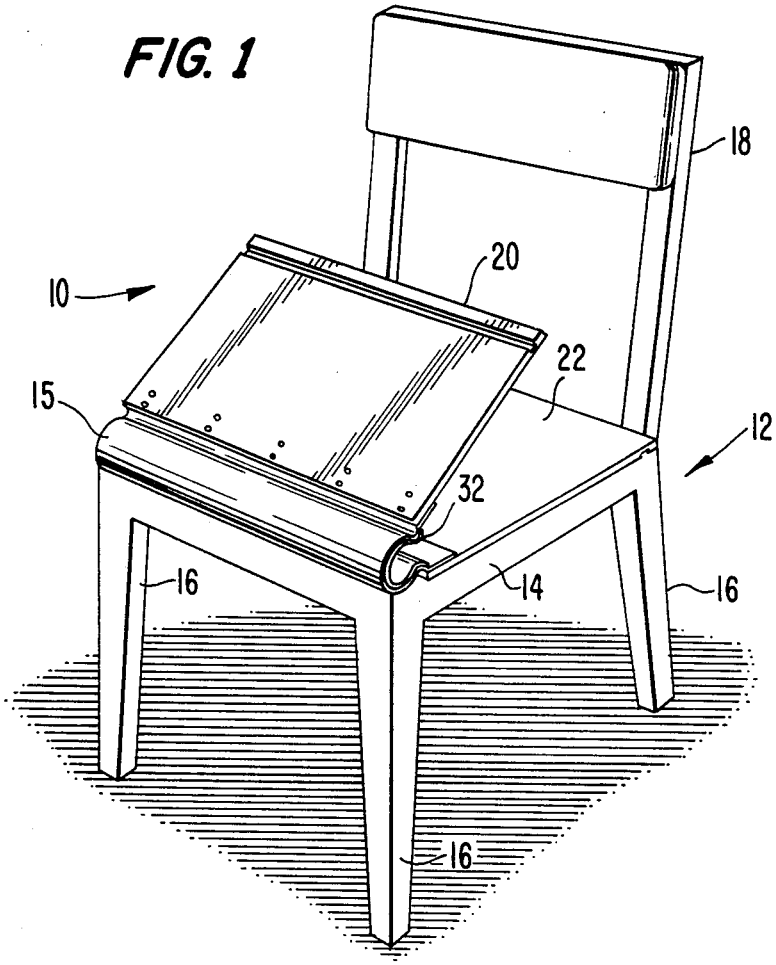
FIG. 1 is a perspective view of one embodiment of the invention wherein the seating assist device is incorporated into a chair.
Figure 2:
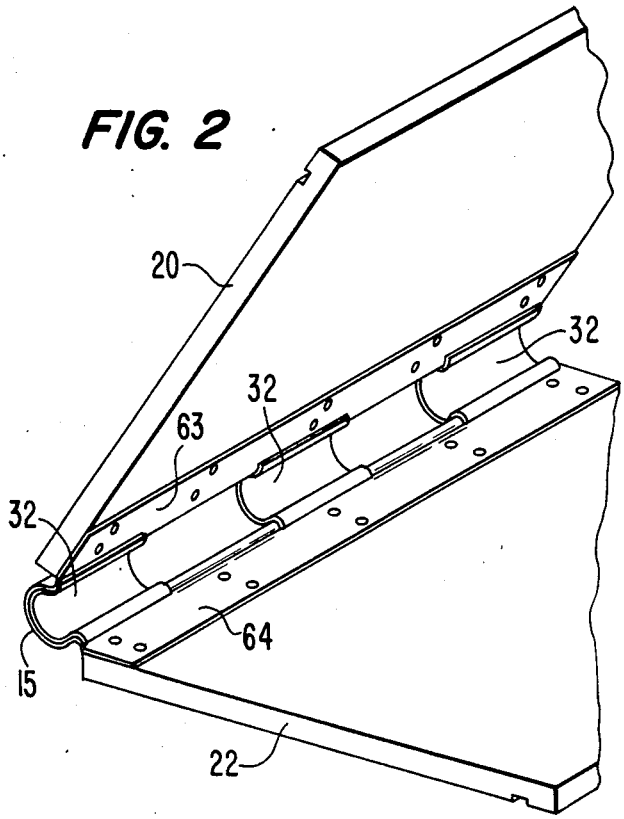
FIG. 2 is a perspective view of another embodiment of the invention showing the main spring means with three helper springs used therewith.
Figure 3:
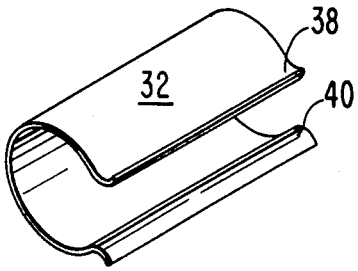
FIG. 3 is a perspective view of one embodiment of a helper spring.

Reference will now be made in detail to the present preferred embodiments of the invention, examples of which are illustrated in the accompanying drawings. Referring now to FIGS. 1 and 2, it may be seen that the seating assist device provides a simple and inexpensive means for helping a person to rise from a seated position. In accordance with the invention, the seating assist device comprises a base member; seat means for receiving a person to a seated position; main spring means for simultaneously acting as a hinge between the base means and the seat means, and exerting a resilient force biasing the seat means away from the base member; and means for adjusting or increasing the resilient force of the main spring means. The adjusting means may include at least one helper spring sized for close fitting relation with the main spring means. In the embodiment illustrated in FIG. 1, the device 10 is generally attached to or incorporated into the structure of a chair 12. Although the illustrated chair 12 includes a relatively flat base portin 14 with legs 16 and a backrest 18, it will be apparent that chair 12 could be designed to have various other configurations.

In the embodiment of FIG. 1, the base member includes a base 22 which is typically generally planar, but may be curved or contoured in many variations, or may be a framework or other portion of a chair. The seat means in this embodiment includes a similar generally planar member 20 which could have the same variation of configurations. In this embodiment, the main spring means includes a spring segment 15 which simultaneously acts as a hinge between the members 20 and 22, and exerts a resilient force biasing the members 20 and 22 away from each other. The segment 15 is formed of a relatively resilient, but highly shape retaining material, and is shaped in its unstressed condition to maintain the members 20 and 22 at an acute angle with respect to each other. The degree of resilience of the shape retaining material is such that the segment 15 exerts a very substantial separating force on the members 20 and 22 when the latter members are forced together. The magnitude of the separating force is sufficient to exert a substantial lifting force on a person forcing the members 20 and 22 together by sitting on the member 20. Thus, when a person attempts to rise from a seated position, the segment 15 exerts a lifting force on the person to assist the person in rising.

In the embodiment of FIG. 1, the segment 15 is shown as a single unitary piece of material having the desired resilient and shape retaining properties. If desired, the members 20 and 22 may be reinforced to prevent them from bending excessively when a person sits on the member 20. This provides additional resistance to flexure so that substantially all of the flexure of the unitary body occurs in the region of the segment 15.

As shown in FIG. 1, the device includes at least one helper spring 32 sized for close fitting relation with the segment 15. This allows the device to be adapted to persons of different weight by varying the degree of resilience of the total spring assembly. Variation in the degree of resilience can also be accomplished by varying the thickness of the material of the segment 15 or modifying the composition of the material of segment 15 toprovide more or less resilience. A compressible resilient material such as rubber or other elastomeric material may be used as a helper spring, and it is specifically contemplated tha the word "spring" should be interpreted to include such an alternative. The helper spring design of the present invention allows the same device to be used for persons of greatly varying weight without any substantial modification or redesign of the parts.

In accordance with the invention, the main spring means may include a generally C-shaped portion, and means for securing the helper spring to the main spring means. As embodied herein and as shown in FIGS. 6 and 7, the segment 15 includes a C-shaped portion 60 with a pair of guides 61 and 62 on opposite ends thereof. As shown in FIG. 7, the helper spring 32 includes a pair of corresponding grooves 71 and 72 for frictionally contacting the guides 61 and 62 when the helper spring 32 is manually inserted within the C-shaped portion 60. Preferably, the helper spring 32 is sized to be spaced from the C-shaped portion 60 except at the grooves 71 and 72 for reducing frictional noise when the spring assembly is stressed. Thus, when the helper spring 32 is slipped into the C-shaped portion 60 by manually exerting a slight squeezing force on the grooves 71 and 72, the only lines of contact betwen the helper spring 32 and the C-shaped portion 60 will be at the guides 61 and 62 and the grooves 71 and 72. Preferably, approximately $\frac{1}{8}$ inch of clearance is left between the helper spring 32 and the C-shaped portion 60.

As used herein in both the specification and claims, the term "generally C-shaped portion" is intended to include other configurations which are not necessarily circular. For example, the C-shaped portion may be formed with corners or other angular junctions without departing from the intended scope or function of this invention.

As shown in FIG. 6, the segment 15 may also include first and second arms 63 and 64, one of the arms 63 and 64 extending from each end of the C-shaped portion 60 for attachment to the base member 22 and the seat member 20, respectively.

The base member 22 and seat member 20 may be formed of any suitable material having sufficient stiffness to withstand the stresses involved in the operation of the device. In addition, as discussed above, either of these members may be reinforced if necessary. Similarly, the segment 15 and the helper springs 32 may be formed of any highly resilient material having the necessary strength properties. Good results have been obtained using high carbon spring steel, but other materials could be used such as plastics including those which can be reinforced by using fiberglass or other high strength fibers.

In the embodiment shown in FIG. 2, the device is not incorporated in a chair, but is fully portable. In this embodiment, the device may be placed on any chair or other furniture piece on which an individual is to be seated. As shown, the base member 22 and the seat member 20 are hinged together by the spring segment 15. Three helper springs 32 are shown in place within the segment 15 for increasing the resilient force of the assembly. As shown in FIG. 4, the arms 63 and 64 may be attached to the members 20 and 22 by suitable bolts 30. However, any fastening means which has sufficient strength and rigidity may be used. FIG. 5 shows the device in a folded position ready for storage. A pair of channels 42 and 44 are provided on the seat member 20 and base member 22, respectively for receiving one or more of the helper springs 32. The helper springs hold the device in the closed position for easy transportability.

In operation, the device is placed on a chair and a person sits on the seat member 20. This causes the segment 15 to be stressed, and the seat member 20 pivots downwardly to overlie the base member 22. The segment 15 then exerts substantial upward pressure on the seat member 20 due to the deflection of the C-shaped portion 60 of segment 15 from the position shown in Fig. 4 to the position shown in FIG. 5. This upward pressure assists the user in rising from the chair.

To increase the amount of resistive force of the members 20 and 22 away from each other, and thereby increase the amount of lifting force provided by the device, a helper spring 32 is placed in position as shown in FIG. 2. The helper spring 32 is substantially C-shaped, and is preferably of the same or similar material as that used for the segment 15. The helper spring 32 has an outside diameter which is approximately the same as the inside diameter of the C-shaped portion 60, so that one or more of the helper springs 32 can fit within the space or length defined by C-shaped portion 60. The helper spring has opposite ends 38 and 40 which are normally spaced apart when a helper spring 32 is in an unstressed condition.

As is evident, when a person sits on the seat member 20 and depresses it, the resulting deflection of the first and second arms 63 and 64 towards each other will force the helper spring 32 to deflect and compress to a smaller diameter, thereby placing the helper spring 32 under stress. Thus, a helper spring 32 will add to the lifting force already provided by the segment 15. This permits the user to incrementally increase the lifting force of the device without any modification to the basic device itself.

The invention also includes an adjustable spring assembly which may be utilized with any object requiring the exertion of a bias on two separate members. In accordance with the invention, the adjustable spring assembly comprises a main spring having a generally C-shaped portion; at least one helper spring sized for close fitting relation with the main spring for increasing the resilient force of the assembly; and means for securing the helper spring to the man spring, including a pair of guides on opposite ends of the C-shaped portion, and a pair of corresponding grooves on the helper spring for frictionally contacting the guides when the helper spring is manually inserted within the C-shaped portion. An embodiment of this spring assembly is shown In FIGS. 2 and 4, and is described fully above. In particular, the main spring 15 has a C-shaped portion 60, and includes a pair of guides 61 and 62 on opposite ends of the C-shaped portion 60. The helper spring 32 incudes a pair of corresponding grooves 71 and 72 for frictionally contacting the guides 61 and 62 when the helper spring 32 is manually inserted within the spring portion 60. In a preferred arrangement, the helper spring 32 is sized to be spaced from the C-shaped portion except at the grooves 71 and 72. Thus, the only lines of contact between the helper spring 32 and the main spring 15 are at the grooves 71 and 72 and the grooves 61 and 62. This results in a structure where there is no substantial noise upon stressing of the main spring 15 because the main spring 15 and the helper spring 32 do not rub against one another except at these line contacts.

As previously mentioned, the main spring 15 may include first and second arms 63 and 64, one of the arms extending from each end of the C-shaped portion 60 for attachment to an object to be biased. The main spring and the helper springs are preferably formed of high carbon spring steel.

It will be apparent to those skilled in the art that various modifications and variations could be made in the present invention without departing from the scope or spirit of the invention.

What is claimed is:

1. A seating assist device comprising:

a base member;

seat means for receiving a person in a seated position;

main spring means for simultaneously acting as a hinge between said base member and said seat means, and exerting a resilient force biasing said seat means away from said base member; and a means for adjusting the resilient force of said main spring means including at least one helper spring which is activatable and deactivatable in a substantially unstressed condition for adjusting the resilient force of the main spring means.

2. The seating assist device of claim 1 wherein said at least one helper spring is sized for close fitting relation with said main spring means.

3. The seating assist device of claim 1 wherein said base member includes a portion of a chair.

4. The device of claim 1 wherein said main spring means includes a plurality of springs, each having a generally C-shaped portion.

5. The device of claim 1 wherein said at least one helper spring includes a plurality of helper springs for varying the resilient force of said main spring means.

6. The device of claim 1 wherein said base member and seat means are formed of lightweight materials, and wherein said device is portable.

7. The device of claim 1 wherein said base member and said seat means are substantially planar and said main spring means maintains said seat means and said base member at an acute angle with respect to each other when said main spring means is in its unstressed condition.

8. The seating assist device of claim 6 wherein said base member is dimensioned for approximately the longitudinal and lateral dimensions of the seat portion of a chair.

9. The seating assist device of claim 1 wherein said main spring means includes a generally C-shaped portion, and means for securing said helper spring to said main spring means.

10. The device of claim 9 wherein said securing means includes a pair of guides on opposite ends of said C-shaped portion, and said helper spring includes a pair of corresponding grooves for frictionally contacting said guides when said helper spring is manually inserted within said C-shaped portion.

11. The device of claim 10 wherein said helper spring is spaced from said C-shaped portion except at said grooves for reducing noise when said main spring means is stressed.

12. The device of claim 11 wherein said main spring means incudes first and second arms, one of said arms extending from each end of said C-shaped portion for attachment to said base member and said seat means, respectively.

13. The device of claim 12 wherein said main spring means and said helper springs are high carbon spring steel.

14. The device of claim 2 wherein said helper spring includes elastomeric material.

15. The device of claim 2 wherein said main spring means includes fiberglass reinforced material.

16. The device of claim 2 wherein said main spring means includes plastic material.

17. The device of claim 16 wherein said plastic material is reinforced.

18. The device of claim 6 including means for maintaining said seat means and said base member substantially adjacent each other in a collapsed position for shipping and travel.

19. The device of claim 18 wherein said maintaining means includes said at least one helper spring.

20. The device of claim 19 wherein at least one of said seat means and said base member includes a channel for receiving said helper spring.

21. the device of claim 20 wherein said main spring means extends along one edge of said seat means and said base member and said channel extends along a surface proximate to the opposing edge of at least one of said seat means and said base member.

22. An adjustable spring assembly comprising:

a main spring having a generally C-shaped portion;

at least one helper spring sized for close fitting relation with said main spring for increasing the resilient force of said assembly; and means for securing said helper spring to said main spring, including a pair of guides on opposite ends of said C-shaped portion, and a pair of corresponding grooves on said helper spring for frictionally contacting said guides when said helper spring is manually inserted within said C-shaped portion.

23. The assembly of claim 22 wherein said helper spring is spaced from said C-shaped portion except at said grooves for reducing noise when said main spring is stressed.

24. The assembly of claim 23 wherein said main spring includes first and second arms, one of said arms extending from each end of said C-shaped portion for attachment to an object to be biased.

25. The assembly of claim 24 wherein said main spring and said helper spring are high carbon spring steel.

26. The assembly of claim 24 wherein said main spring and said helper spring include fiberglass reinforced material.

* * * * *